US005099225A

United States Patent [19]

Narlow et al.

[11] Patent Number: 5,099,225

[45] Date of Patent: Mar. 24, 1992

[54] ELECTROSTATIC TAG FOR USE IN AN EAS SYSTEM

[75] Inventors: Doug Narlow, Coral Springs; Hubert A. Patterson, Boca Raton, both of Fla.

[73] Assignee: Sensormatic Electronics Corporation, Deerfield Beach, Fla.

[21] Appl. No.: 619,730

[22] Filed: Nov. 29, 1990

[51] Int. Cl.[5] ..... G08B 13/22

[52] U.S. Cl. ..... 340/572

[58] Field of Search ..... 340/572

[56] References Cited

U.S. PATENT DOCUMENTS

| | | | |
|---|---|---|---|
| 3,754,226 | 8/1973 | Fearon | 340/572 |
| 4,206,453 | 6/1980 | Williamson | 340/572 |
| 4,212,002 | 7/1980 | Williamson | 340/572 |
| 4,660,025 | 4/1987 | Humphrey | 340/572 |

*Primary Examiner*—Glen R. Swann, III

*Attorney, Agent, or Firm*—Robin, Blecker, Daley & Driscoll

[57] ABSTRACT

An electrostatic tag formed from an antenna and a capacitor is disclosed. The capacitor has a charge which changes from a first charge value to a second charge value when the voltage across the capacitor reaches a first threshold value and from the second charge value to the first charge value when the voltage reaches a second threshold value. The capacitor has a dielectric which changes from a first to second dielectric value and from the second to first dielectric value at the first and second voltage thresholds. The capacitor plates also are extended beyond the dielectric to form the antenna of the tag. The tag is used in an electronic article surveillance system which generates an electrostatic field which causes one or the other of the threshold voltages to be exceeded when a tag is exposed to the field. This results in a charge change in the capacitor and a detectable electrostatic pulse is generated.

28 Claims, 2 Drawing Sheets

ELECTROSTATIC TAG FOR USE IN AN EAS SYSTEM

BACKGROUND OF THE INVENTION

This invention relates to tags and, in particular, to tags for use in article surveillance systems.

Article surveillance systems are known in the art wherein magnetic tags are affixed to articles and used to maintain the articles under surveillance. Humphrey, U.S. Pat. No. 4,660,025, issued Apr. 21, 1987, and the patents cited therein disclose magnetic article surveillance systems of this type.

In such magnetic surveillance systems, an alternating magnetic field is formed in a surveillance zone and a magnetic tag passing through the zone causes a perturbation to the field. This perturbation is detected and used to activate an alarm, indicating the presence of the tag and the article carrying the tag in the zone.

In these systems, the extent of the surveillance zone and the reliability of detection is constrained by the physical laws associated with magnetic fields. It is well known that a magnetic field decreases in magnitude at a cubic rate as a function of distance. Therefore, the distance over which a magnetic field can travel is limited.

To compensate for this decrease in field strength, magnetic surveillance systems have been required to use magnetic fields of relatively high strength within the surveillance zone. However, the need to use fields of high strength increases the equipment cost of the magnetic system.

Other attempts to compensate for the drop off in magnetic field as a function of distance have involved increasing the sensitivity of the system receiver. However, increasing the sensitivity of the system receiver, makes the system more prone to interference from background noise. Accordingly, the cubic drop off of the magnetic field continues to be a governing constraint in designing magnetic article surveillance systems.

Another constraint in magnetic systems is that, in certain instances, ordinary objects passing through the surveillance zone can result in false alarms. This effect can be minimized by decreasing the sensitivity of the system receiver to all perturbations, except those generated by valid tags. However, this often results in decreasing the desired range of the system and/or increasing the cost and complexity of the receiver.

It is therefore an object of the present invention to provide a tag for an article surveillance system which is less prone to result in the above disadvantages.

It is a further object of the present invention to provide an article surveillance system tag which is responsive to applied fields whose strength drops off with distance at a lesser rate than for magnetic fields.

It is further object of the present invention to provide an article surveillance system tag that responds to an electrostatic field.

SUMMARY OF THE INVENTION

In accordance with the principles of the present invention, the above and other objectives are realized in an article surveillance system tag comprising an antenna means which is responsive to an electrostatic field and a capacitance means connected to the antenna means and having a charge which changes from a first charge value to a second charge value when the voltage across the capacitance means reaches a first threshold value. By controlling the electrostatic field so as to apply the threshold voltage to the capacitance means, the charge on the capacitance means changes from one value to the other. This results in an electrostatic pulse which can be detected to sense the presence of the tag.

In the embodiment of the invention to be disclosed hereinafter, the capacitance means includes a capacitor having a dielectric whose dielectric constant changes from a first to second dielectric constant value at the threshold voltage to cause the charge to change from the first to second charge value. The dielectric of the capacitor is also such as to change from the second to first dielectric constant value at a second threshold value which is of opposite polarity to the first threshold value. At the second threshold value the capacitor charge thus changes from the second to first charge value, thereby also resulting in a pulse. By causing the electrostatic field to alternate in polarity, one of the thresholds will always be reached resulting in the desired electrostatic pulse for sensing the tag.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
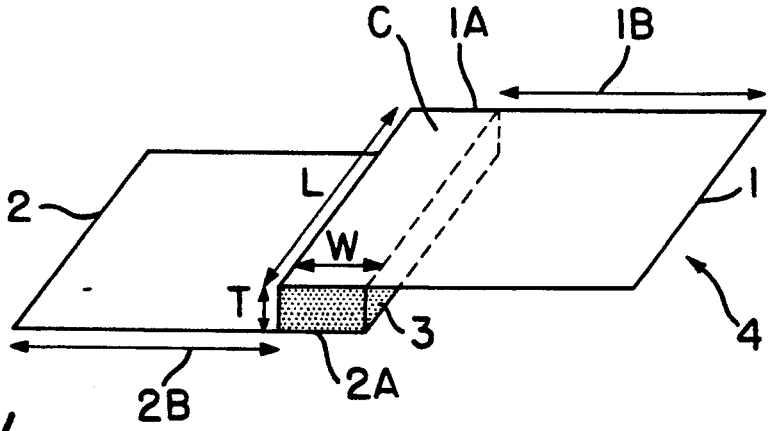
FIG. 1 shows an electrostatic tag in accordance with the principles of the present invention.

FIG. 1 shows an electrostatic tag 4 in accordance with the principles of the present invention. The tag 4 comprises two spaced metallic plates 1 and 2 separated by a distance T. Corresponding marginal portions 1A and 2A of the plates 1 and 2 overlap and sandwich a dielectric 3. These plate portions and the sandwiched dielectric 3 form a capacitor C having a width W, length L and thickness T. The non-overlapping portions of the plates 1 and 2, in turn, form electrostatic antennas 1B and 2B, respectively.

The charge Q across the the capacitor C can be expressed by the following equation:

$$Q = \frac{V \cdot K \cdot E_o A_d}{T} \quad (1)$$

Where:

L=length of conductive plates portions 1A, 1B

W=width of the conductive plates portions 1A, 1B.

$A_d$=L * W=area of the conductive plate.

K=the dielectric constant of the dielectric

T=thickness of the dielectric $E_o$=permittivity constant=$8.85 \times 10^{-12}$F/m V=the voltage across the capacitor In accordance with the principles of the present invention, the capacitor C is further adapted so that its above charge Q undergoes changes from one charge value to another at certain threshold voltages across the capacitor. These threshold voltages are developed from electrostatic fields received by the electrostatic antenna 1B and 2B and coupled to the capacitor plates. The resultant changes in charge on the capacitor C at the thresholds, in turn, result in the capacitor generating an electrostatic pulse which is transmitted by the antenna and can be used to detect the presence of the tag 4.

The capacitor C of the tag 4 is adapted to accomplish the above by selecting the dielectric 3 of the capacitor to be a material which exhibits a hysteresis type change in dielectric constant with applied voltage. Suitable dielectrics exhibiting such a characteristic are ferroelectric dielectrics. Particular ferroelectric dielectrics are lead zirconium titanate (PZT), potassium nitrate, bismuth nitrate and lead germanate.

Figure 2:
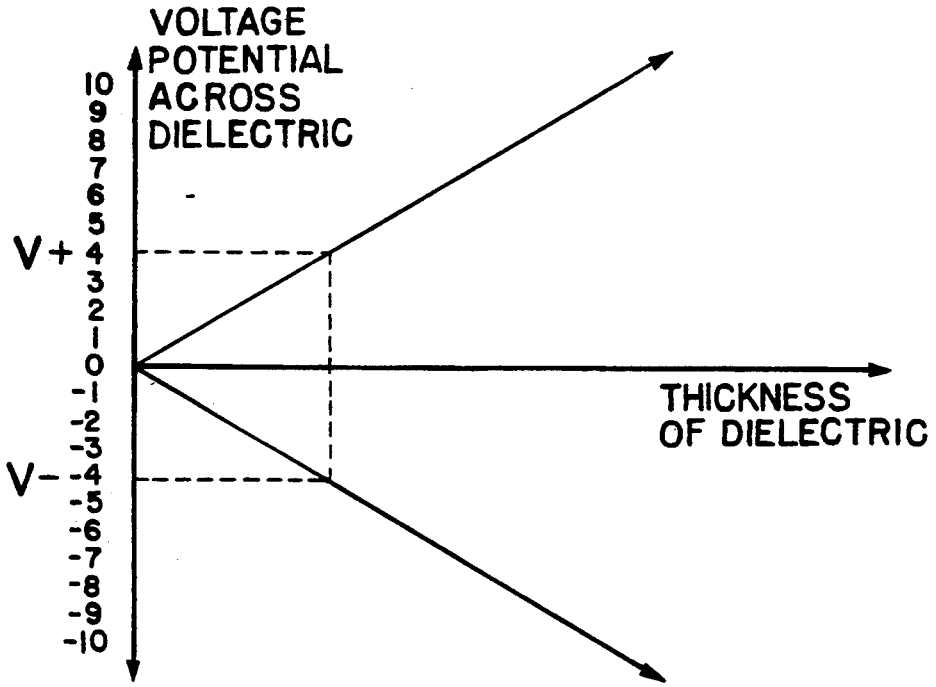
FIG. 2 illustrates the threshold voltage as a function of the dielectric thickness for the dielectric of the capacitator of the tag of FIG. 1.

FIG. 2 is a representative graph illustrating the positive and negative voltage thresholds at which the dielectric constant of the dielectric 3 switches as a function of the thickness T. In FIG. 2, the abscissa represents the thickness T and the ordinate represents the voltage V required across the dielectric 3 to switch its dielectric constant. As shown, for each dielectric thickness T, a threshold voltage V+ is required to ensure that the dielectric constant is at a first value. Similarly, for the same dielectric thickness, a negative threshold voltage V− is required to ensure that the dielectric constant is at a second value. For a PZT material of thickness 3000 A, K1=600, K2=1200 and V±=5 volts.

Figure 3:
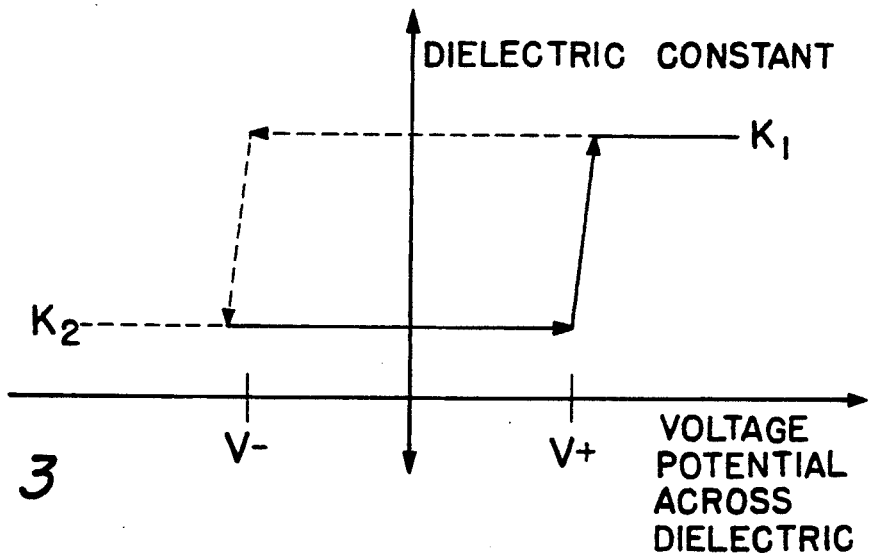
FIG. 3 illustrates the change in dielectric constant as a function of voltage of the dielectric of the capacitor of the tag of FIG. 1.

FIG. 3 is a graph illustrating the voltage potential across the conductive plates 1A and 1B of the capacitor C versus the dielectic constant value for the dielectric 3. Starting with a voltage potential exceeding V+, the dielectric constant is at a first value K1. As the voltage is reduced, the dielectric constant remains at K1 until a negative threshold voltage V− is reached. Upon reaching V−, the dielectric constant switches stepwise to a lower value K2. For all voltages below V−, the dielectric constant remains at K2. Threafter, when increasing the voltage, the dielectric constant remains at K2 until the voltage reaches V+, at which time the dielectric constant switches stepwise to the higher value K1.

The hysteresis characteristic of the dielectric constant of the dielectric 3 permits the charge Q on the capacitor C to be switched between two values by temporarily applying a voltage to the capacitor substantially equal to or greater than V+ or substantially equal to or less than V−. For example, by temporarily applying a voltage of V+ across the capacitor C, a charge value of $Q_1$ is obtained as follows:

$$Q_1 = \frac{V+ \cdot K_1 \cdot E_o \cdot A_d}{T} \quad (2)$$

Upon removing the voltage potential V+, K1 will remain as the dielectric constant until a negative voltage potential V− is applied, at which time the charge value Q2 is obtained. as follows:

$$Q2 = \frac{V- \cdot K_2 \cdot E_o \cdot A_d}{T} \quad (3)$$

Upon removing the voltage potential V−, K2 will remain as the dielectric constant until a voltage V+ is subsequently applied, at which time the charge value returns to Q1.

Figure 4:
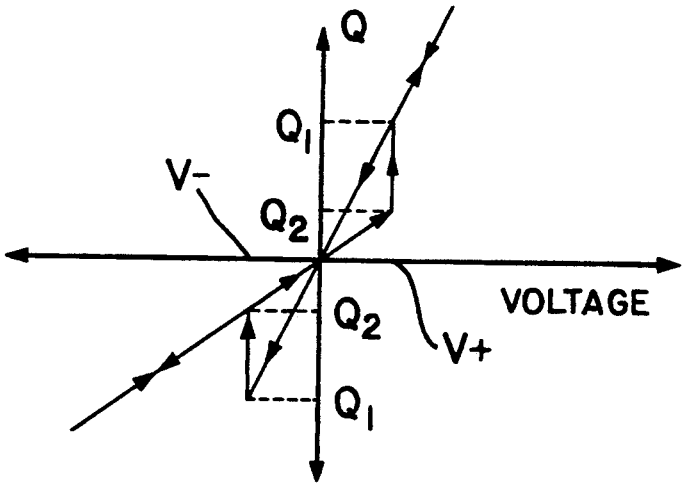
FIG. 4 illustrates the change in charge as a function of voltage of the capacitor of the tag of FIG. 1.

FIG. 4 shows the charge Q versus voltage across the capacitor C. When the voltage is increased to the voltage V+, the charge Q quickly changes from Q2 to Q1. Even when the voltage potential is removed, due to the hysteresis characteristic, the capacitor C will remain charged to Q1. However, when the applied voltage is reduced to V−, the capacitor C will quickly change its charge from Q1 to Q2. Thereafter, even if the voltage potential V− is removed the tag will continue to have a charge value of Q2, due to the hysteresis characteristic.

During the transitions or changes from the charge state Q1 to Q2 and from Q2 to Q1, an electrostatic pulse is developed by the capacitor C and radiated by the antennas 1B and 2B. This electrostatic pulse is unique and rich in harmonics and, because it is electrostatic, its magnitude decreases or drops off at one over the square of the distance as opposed one over the cube of the distance as with magnetic fields. Accordingly, the electrostatic pulse can be sensed and detected at further distances, thereby permitting a surveillance zone of increased extent for the tag 4.

Figure 5:
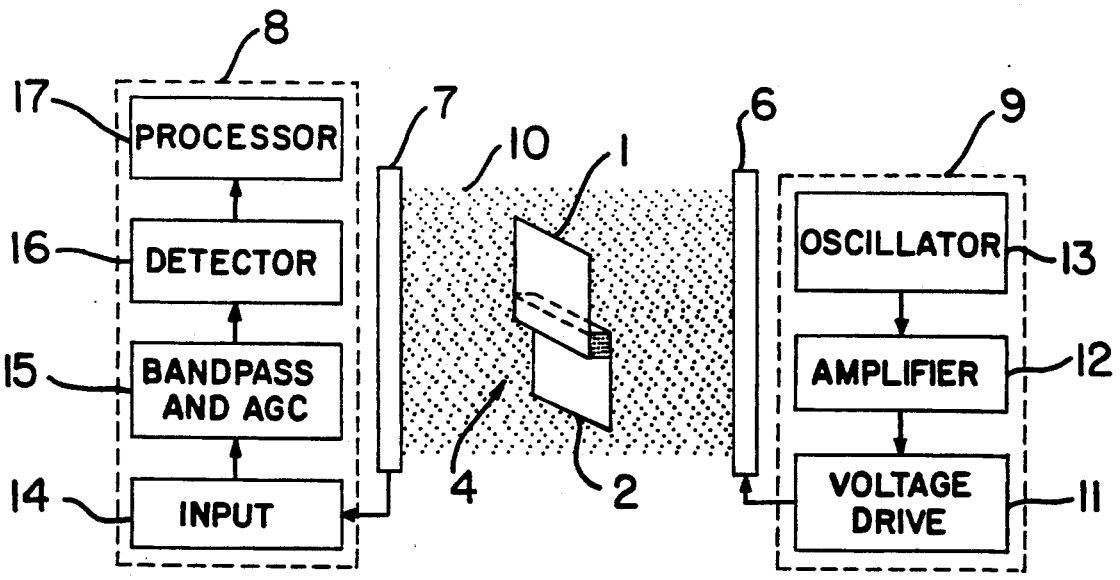
FIG. 5 illustrates an electrostatic article surveillance system for use with tag of FIG. 1.

FIG. 5 shows an article surveillance system adapted for use with the tag 4. An electrostatic transmitter 9 is connected to electrostatic antenna 6 for establishing an electrostatic field in a surveillance zone 10. The transmitter 9 includes an oscillator 13 for generating an alternately positive and negative signal, an amplifier 12 for increasing the level of the signal generated by the oscillator 13, and a drive circuit 11 for connecting the amplifier 12 to the electrostatic antenna 6. Due to the alternating signal of the oscillator 13, the electrostatic field in the zone 10 also alternates so as to provide a voltage to the tag 4 which exceeds the thresholds V+ and V− needed to switch the charge state of the tag 4. The tag 4 will thus result in an electrostatic pulse in the zone 10.

The pulse generated by the tag 4 is sensed and detected by an electrostatic receiving antenna 7 coupled to receiving unit 8. The receiving unit 8 is tuned to one or more harmonics of the frequency of the alternating electrostatic field in the zone 10 expected to be contained in the electrostatic pulse generated by the tag 4. As shown, the receiving unit 8 comprises an input amplifier 14 for increasing the level of the received signal, a bandpass filter and an automatic gain control circuit 15 for rejecting noise and isolating the desired harmonics, a detector 16 for detecting the latter, and a processor 17 for generating appropriate responses, such as an alarm.

While in FIG. 5, an alternating electrostatic field is established in the zone 10, a high voltage pulse transient of appropriate polarity may instead be used. This pulse would likewise switch the charge on the capacitor C to thereby generate the desired electrostatic pulses.

The tag 4 of the invention provides a unique electrostatic response that is not generated by tags currently available or by ordinary objects existing in the environment. This ensures that false alarms will not be initiated when an object other than an electrostatic tag is brought within the detection zone. The electrostatic tag 4 and the electrostatic surveillance system of the invention are advantageous in a number of other respects.

One primary advantage already mentioned above, is that the tag and system operate with electrostatic fields which drop off at a square rate, rather a cubic rate as with magnetic fields. This permits the surveillance zone to be of larger extent for the same strength signal generated. A further advantage is that the switching time of the tag 4 is not affected by the tag size (capacitor size).

However, increasing the tag size does increase the magnitude of the electrostatic pulse generated. A still further advantage is that the capacitor switching operates well into the megahertz range, making the tag suitable for both fixed frequency and swept frequency applications.

In all cases it is understood that the above-described arrangements are merely illustrative of the many possible specific embodiments which represent applications of the present invention. Numerous and varied other arrangements can readily be devised in accordance with the principles of the present invention without departing from the spirit and scope of the invention. For example, the electrostatic tag 4, as shown in FIG. 1, has electrostatic antennas formed by extensions 1B and 2B of the capacitor plates 1A and 2A. Alternatively, the electrostatic antennas may be actual wires or other forms of antenna attached to the capacitor plates.

What is Claimed is:

1. An electrostatic tag for use in an article surveillance system in which an electrostatic field is established in a surveillance zone and an alarm is activated when a predetermined perturbation to said field is detected, said electrostatic tag comprising:

antenna means responsive to an electrostatic field;

and capacitance means connected to said antenna means, said capacitance means having a charge that changes from a first charge value to a second charge value when the voltage across the capacitance means reaches a first threshold voltage, thereby causing said tag to generate an electrostatic pulse.

2. A tag in accordance with claim 1 wherein:

said capacitance means has a charge which changes from said second charge value to said first charge value when the voltage across said capacitance means reaches a second threshold value, thereby causing said tag to generate an electrostatic pulse.

3. A tag in accordance with claim 2 wherein:

said change from said first to second charge value is substantially step-wise;

and said change from said second to first charge value is substantially step-wise.

4. A tag in accordance with claim 2 wherein:

said first and second threshold voltages are of opposite polarity.

5. A tag in accordance with claim 2 wherein:

said capacitance means comprises a capacitor having a dielectric whose dielectric constant is at a first dielectric constant value for voltages applied to said capacitor equal to or exceeding said first threshold voltage and whose dielectric constant is at a second dielectric constant value for voltages which are equal to or less than said second threshold voltage, said first threshold voltage exceeding said second threshold voltage.

6. A tag in accordance with claim 5 wherein:

the dielectric constant of said dielectric of said capacitor remains at said second dielectric constant for voltages increasing from below said second threshold voltage to said first threshold voltage at which said dielectric constant undergoes substantially a step change to said first dielectric constant value;

and the dielectric constant of said dielectric of said capacitor remains at said first dielectric constant value for voltages decreasing from above said first threshold voltage to said second threshold voltage at which said dielectric constant undergoes substantially a step change to said second dielectric constant value.

7. A tag in accordance with claim 1, wherein:

the voltage formed across said capacitance means is related to said electrostatic field.

8. A tag in accordance with claim 1, wherein:

said capacitance means comprises a capacitor having a dielectric.

9. A tag in accordance with claim 8, wherein:

said dielectric is a ferroelectric dielectric.

10. A tag in accordance with claim 9, wherein:

said ferroelectric dielectric is one of lead zirconium titanate, potassium nitrate, bismuth titanate and lead germanate.

11. A tag in accordance with claim 8, wherein:

said capacitor includes first and second spaced plates sandwiching said dielectric; and said antenna means comprises an extension of at least one of said first and second plates.

12. A tag in accordance with claim 11, wherein:

said antenna means comprises an extension of said first plate in a first direction and an extension of said second plate in a second direction opposite said first direction.

13. An article surveillance system for detecting the presence of an article in a surveillance zone, the system comprising:

means for generating an electrostatic field within said surveillance zone;

an electrostatic tag comprising: antenna means responsive to said electrostatic field; and capacitance means connected to said antenna means, said capacitance means having a charge that changes from a first charge value to a second charge value when the voltage across the capacitance means reaches a first threshold voltage, thereby causing said tag to generate an electrostatic pulse; and means for detecting perturbations of the electrostatic field in said zone.

14. A system in accordance with claim 13 wherein:

said capacitance means has a charge which changes from said second charge value to said first charge value when the voltage across said capacitance means reaches a second threshold value, thereby causing said tag to generate an electrostatic pulse in said zone.

15. A system in accordance with claim 14 wherein:

said change from said first to second charge value is substantially step-wise;

and said change from said second to first charge value is substantially step-wise.

16. A system in accordance with claim 14 wherein:

said first and second threshold voltages are of opposite polarity.

17. A system in accordance with claim 14 wherein:

said capacitance means comprises a capacitor having a dielectric whose dielectric constant is at a first dielectric constant value for voltages applied to said capacitor equal to or exceeding said first threshold voltage and whose dielectric constant is at a second dielectric constant value for voltages which are equal to or less than said second threshold voltage, said first threshold voltage exceeding said second threshold voltage.

18. A system in accordance with claim 17 wherein:

the dielectric constant of said dielectric of said capacitor remains at said second dielectric constant for voltages increasing from below said second threshold voltage to said first threshold voltage at which said dielectric constant undergoes substantially a step change to said first dielectric constant value;

and the dielectric constant of said dielectric of said capacitor remains at said first dielectric constant value for voltages decreasing from above said first threshold voltage to said second threshold voltage at which said dielectric constant undergoes substantially a step change to said second dielectric constant value.

19. A system in accordance with claim 13, wherein: said capacitance comprises a capacitor having a dielectric.

20. A system in accordance with claim 19, wherein: said dielectric is a ferroelectric dielectric.

21. A system in accordance with claim 20, wherein: said ferroelectric dielectric is one of potassium nitrate, lead zirconium titanate, bismuth titanate and lead germanate.

22. A system in accordance with claim 19, wherein: said capacitor includes first and second spaced plates sandwiching said dielectric;

and said antenna means comprises an extension of at least one of said first and second plates.

23. A system in accordance with claim 22, wherein: said antenna means comprises an extension of said first plate in a first direction and an extension of said second plate in a second direction opposite said first direction.

24. A system in accordance with claim 13 wherein: said means for generating an alternating electrostatic field comprises: transmitter means; and an electrostatic transmitting antenna connected to said transmitter means.

25. A system in accordance with claim 24, wherein: said means for detecting perturbations comprises: a receiver means; and an electrostatic receiving antenna connected to said receiver means.

26. A system in accordance with claim 13 wherein: said electrostatic field is an alternating electrostatic field at a given frequency;

and said detecting means senses perturbations at one or more harmonics of said given frequency.

27. A method for detecting the presence of an article in a surveillance zone comprising:

generating an electrostatic field within said zone;

passing an electrostatic tag through said zone, said electrostatic tag comprising: antenna means responsive to said electrostatic field; and a capacitance means connected to said antenna means, said capacitance means having a charge that changes from a first charge value to a second charge value when the voltage across the capacitor reaches a first threshold voltage, thereby causing said tag to generate an electrostatic pulse;

and detecting the perturbations to the electrostatic field in said zone.

28. A method in accordance with claim 27, wherein: the generated electrostatic field is an alternating electrostatic field at a given frequency; and said detecting includes sensing perturbations to said electrostatic field at one or more harmonics of said given frequency.

* * * * *